US005522951A

United States Patent [19]

Chen

[11] Patent Number: 5,522,951

[45] Date of Patent: Jun. 4, 1996

[54] METHOD FOR MANUFACTURING A ZINC WIRE

[76] Inventor: Chang-Shu Chen, No. 8, Lane 55, Sec. 2, Kuei-Yang St.,, Taipei City, Taiwan

[21] Appl. No.: 489,997

[22] Filed: Jun. 12, 1995

[51] Int. Cl.[6] ..... B22D 7/00; C21D 1/00; C22F 1/00

[52] U.S. Cl. ..... 148/557; 148/576; 72/286

[58] Field of Search ..... 148/557, 576; 72/286

[56] References Cited

U.S. PATENT DOCUMENTS 3,146,098 8/1964 Saarivirta et al. ..... 148/557
4,688,411 8/1987 Hagita et al. ..... 72/42

*Primary Examiner*—Sikyin Ip

*Attorney, Agent, or Firm*—Rodman & Rodman

[57] ABSTRACT

A method for manufacturing a zinc wire includes the following steps: (1) casting a molten zinc ingot into a zinc rod; (2) annealing the zinc rod by heating the zinc rod at a temperature of 250° C.–310° C. for more than 30 minutes, and then cooling the zinc rod to room temperature; (3) extruding the annealed zinc rod at a temperature of 250° C.–310° C. to form a zinc bar; (4) air cooling the zinc bar to room temperature after step (3); (5) immersing the cooled zinc bar into a liquid having a boiling point of about 100° C.–150° C.; (6) heating the liquid at its boiling point for a predetermined period; (7) subsequently removing the zinc bar from the liquid, and then baking and drying the zinc bar; (8) forming the baked zinc bar into a rough zinc wire by continuous rolling; (9) subjecting the rough zinc wire, after rolling, to a treatment for peeling off a surface layer of the rough zinc wire; and (10) subsequent to the peeling treatment, drawing the rough zinc wire to form a fine zinc wire.

3 Claims, 2 Drawing Sheets

METHOD FOR MANUFACTURING A ZINC WIRE

BACKGROUND OF THE INVENTION

1. Field of the Invention

This invention relates to a method for manufacturing a zinc wire, more particularly to a manufacturing method which can produce a highly ductile zinc wire.

2. Description of the Related Art

In general, zinc (Zn), which has a good anti-corrosion property, is largely used as a protective coating for metallic structures and is applied by means of a metal spraying process with the use of a spray gun. In addition, zinc may be sprayed on non-metallic materials so as to form a conductive outer layer on the non-metallic materials.

In order to facilitate carrying of the metal spraying apparatus, the zinc wires used when spraying a zinc layer onto the metallic structures and the non-metallic materials must be flexible so as to be formed into a coil. In use, the coiled zinc wire is connected to a spray gun so that it can be moved along with the gun and melted within the spray gun for spray-coating on the surfaces of the metallic structures and the non-metallic materials. Usually, the zinc wire used for spray-coating is made from zinc of more than 99.9% purity and has a diameter of about 1–6 mm. However, it is quite difficult to manufacture a 1–6 mm diameter zinc wire from a cast zinc ingot.

With the HCP (hexagonal close-packed lattice) crystalline structure, zinc is relatively hard and brittle at room temperature so that it has poor processability. Zinc becomes ductile at a higher temperature. At a temperature of 100°–150° C., the ductility of zinc substantially increases so that it can be pressed to form sheets or drawn into wires. When zinc is heated to a temperature of 200° C., its grain size becomes coarse. Thus, zinc returns to its brittle form so that, when it undergoes manufacturing processes such as rolling or drawing, work-hardening occurs due to the deterioration of the zinc lattices.

As mentioned above, zinc is liable to become hard and brittle in the processing thereof. If the ductility of zinc is not increased enough to a proper condition during the manufacturing process, it would cause problems, such as wire jam, overload and wire breakage, to the machines used in the manufacturing processes, such as rolling and drawing. This will result in an increase in the manufacturing costs. In addition, if the final zinc wire product is hard and brittle, it cannot be wound into a coil and may even break.

SUMMARY OF THE INVENTION

Therefore, the main objective of this present invention is to provide a method for manufacturing a zinc wire, which produces a soft and highly plastic zinc wire that can be easily wound to form a coil.

According to this invention, a method for manufacturing a zinc wire comprises the following steps:

(1) casting a molten zinc ingot into a zinc rod;

(2) annealing the zinc rod by heating the zinc rod at a temperature of 250° C.–310° C. for more than 30 minutes, and then cooling the zinc rod to room temperature;

(3) extruding the annealed zinc rod at a temperature of 250° C.–310° C. to form a zinc bar;

(4) air cooling the zinc bar to room temperature after step (3);

(5) immersing the cooled zinc bar into a liquid having a boiling point of about 100° C.–150° C.;

(6) heating the liquid at its boiling point for a predetermined period;

(7) subsequently removing the zinc bar from the liquid, and then baking and drying the zinc bar;

(8) forming the baked zinc bar into a rough zinc wire by continuous rolling;

(9) subjecting the rough zinc wire, after rolling, to a treatment for peeling off a surface layer of the rough zinc wire; and

(10) subsequent to the peeling treatment, drawing the rough zinc wire so as to have a predetermined dimension.

BRIEF DESCRIPTION OF THE DRAWINGS

Other features and advantages of this present invention will become apparent in the following detailed description of a preferred embodiment of this invention, with reference to the accompanying drawings, of which.

DETAILED DESCRIPTION OF THE PREFERRED EMBODIMENT

Figure 1:
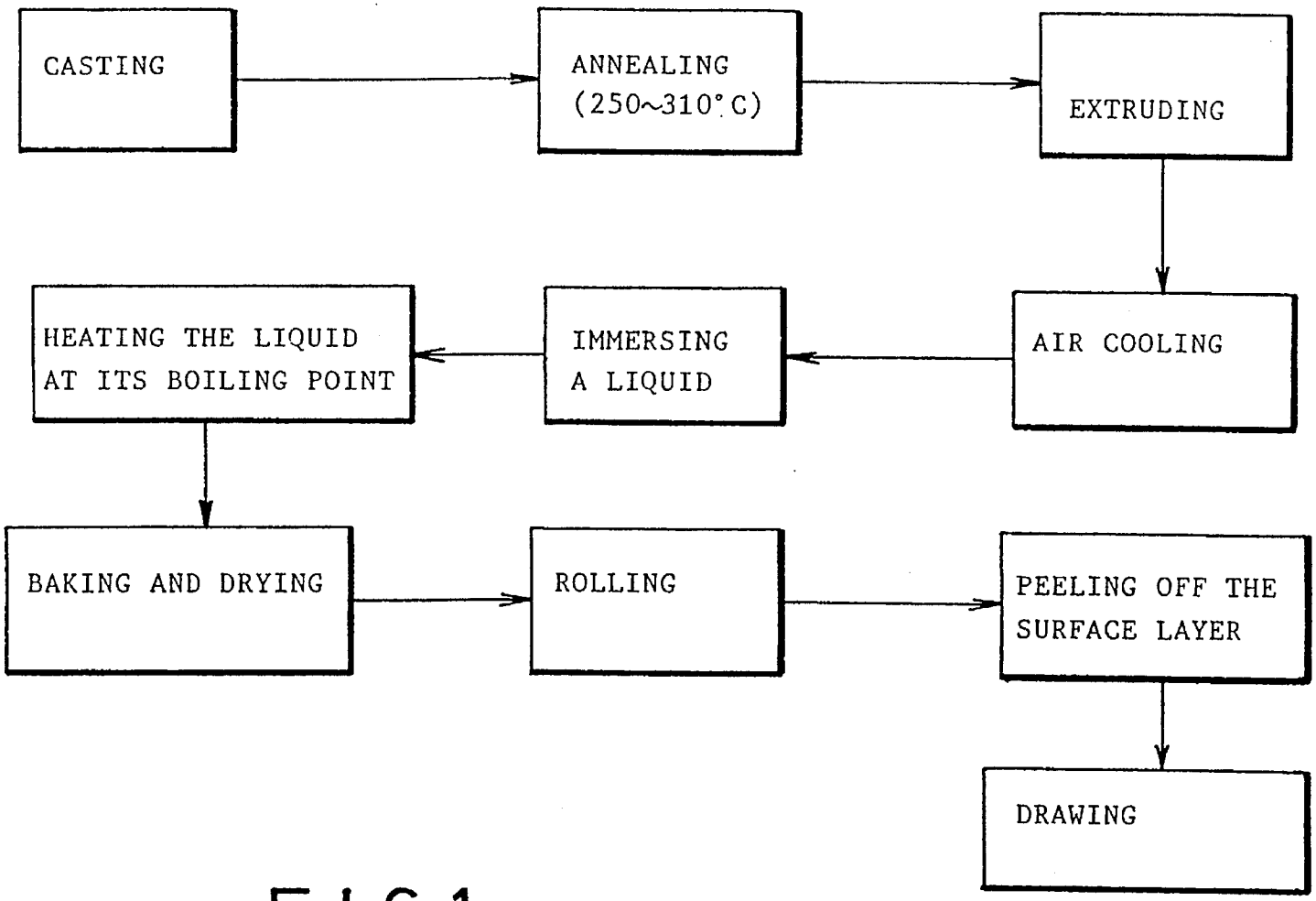
FIG. 1 is a flow diagram illustrating a method for manufacturing a zinc wire in accordance with the preferred embodiment of this invention.

The preferred embodiment of a zinc wire manufacturing process according to this invention, as shown in FIG. 1, includes the following steps:

(1) casting a molten zinc ingot into a zinc rod having a purity of more than 99.9%;

(2) annealing the zinc rod by heating the zinc rod at a temperature of 250° C.–310° C. for more than 30 minutes, and then cooling the zinc rod to room temperature in order to remove internal stresses of the zinc rod and to make the zinc rod less brittle, thereby homogenizing the zinc rod;

(3) extruding the annealed zinc rod at a temperature of 250° C.–310° C. to form a zinc bar with a diameter of about 5–10 mm;

(4) air cooling the zinc bar to room temperature after step (3);

(5) immersing the cooled zinc bar into a liquid having a boiling point of about 100° C.–150° C.;

(6) heating the liquid at its boiling point for more than 20 minutes so as to heat evenly the zinc bar from its outer surface to its inner portion to the temperature of the boiling point of the liquid;

(7) subsequently removing the zinc bar from the liquid, and then baking the zinc bar by using low pressure gas (LPG) so as to dry the zinc bar;

(8) forming the baked zinc bar into a 3–4 mm-diameter rough zinc wire by continuous rolling;

(9) subjecting the rough zinc wire, after rolling, to a treatment for peeling off a surface layer of the rough zinc wire so as to remove the work-hardened layer formed due to the continuous rolling applied on the rough zinc wire; and

(10) subsequent to the peeling treatment, drawing the rough zinc wire to form a zinc wire with a diameter of about 1–3 mm.

According to the above-described steps, zinc can be controlled to have high ductility during the manufacturing process so that it is resistant to breakage and can be wound to form a coil easily.

The following testing methods are applied to prove that the zinc wire manufactured by the method of this invention has excellent properties.

Comparative Example

Figure 2:
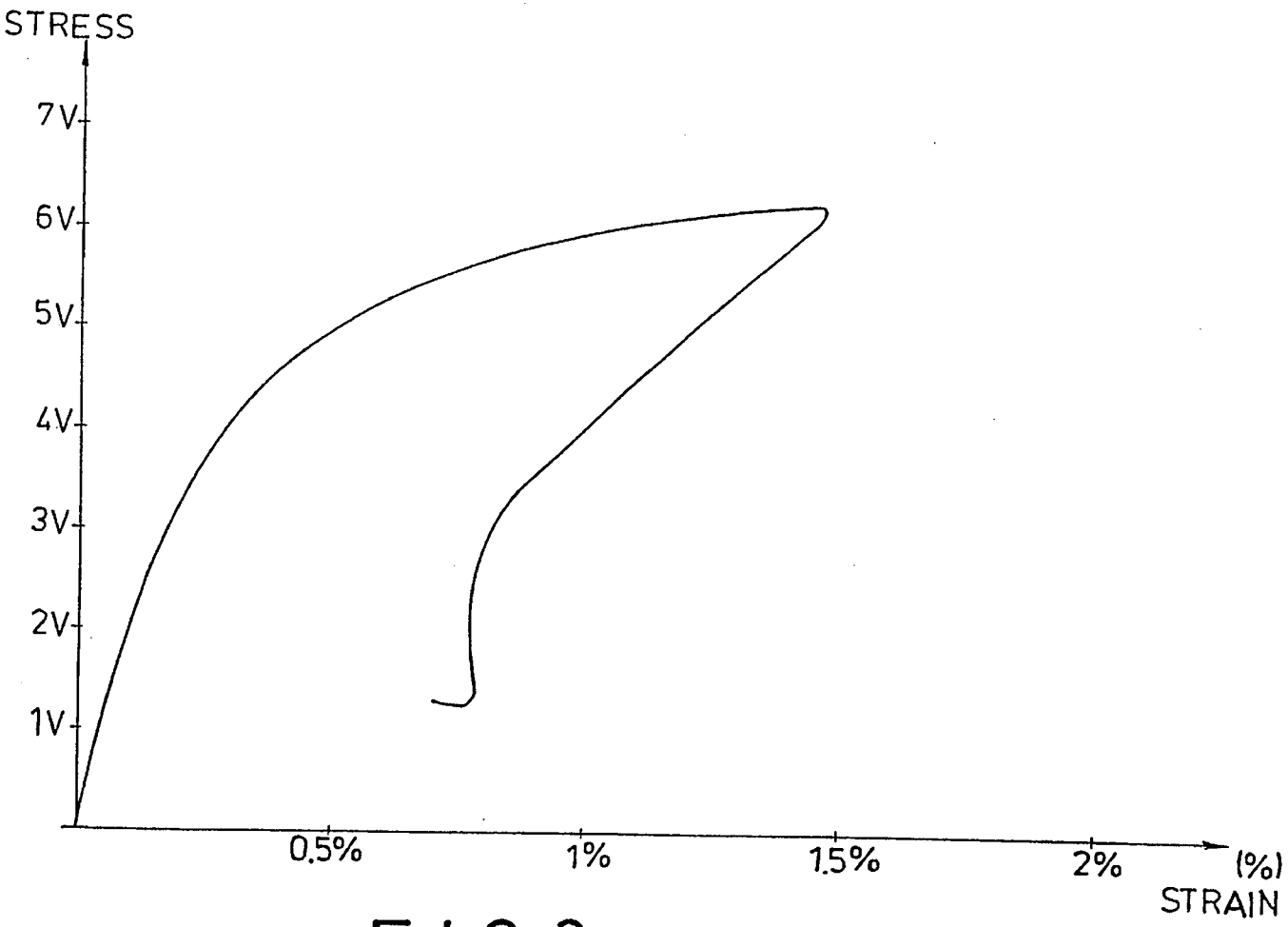
FIG. 2 is a stress-strain curve diagram for a zinc bar which is produced by extruding a zinc rod at the step (3) of the method of this invention.

A zinc bar, which has a diameter of about 7.25 mm, was used as a specimen in this Example. The specimen was a wire of about 7.25 mm obtained after the extruding step (3) of the method of the present invention. A tensile test is applied to test the zinc bar. FIG. 2 is a stress-strain curved diagram illustrating the results of the specimen. As illustrated, the maximum strain of the specimen occurs at about 1.47 percent elongation, and the maximum stress is about 244 MPa. In addition, there is no occurrence of necking at the fracture point of the specimen. According to the above-measured data, the tested zinc bar is hard and brittle.

EXAMPLE

The zinc wire fabricated by the method of this invention was used to make specimens in the test. The test results are as follows:

TABLE (A)

| | initial length (L) meter | final length (Lf) meter | percent elongation (Lf − L)/L |
|---|---|---|---|
| specimen #1 | 1 m | 1.18 m | 18% |
| specimen #2 | 1 m | 1.20 m | 20% |
| specimen #3 | 1 m | 1.18 m | 18% |

TABLE (B)

| | initial cross-sectional diameter (D) mm | final cross-sectional diameter (Df) mm | percent reduction in cross-sectional area $(D^2 - Df^2)/D^2$ |
|---|---|---|---|
| specimen #1 | 3.35 mm | 3.10 mm | 14.4% |
| specimen #2 | 3.20 mm | 3.00 mm | 12.1% |
| specimen #3 | 2.75 mm | 2.55 mm | 14.0% |

Table (A) lists the percent elongations for three specimens made according to this invention. According to the measured data in Table (A), the average percent elongation for the specimens is 18.66 %.

Table (B) lists the percent reductions in cross-sectional areas for the specimens. According to the measured data in Table (B), the average percent reduction in area for the fine zinc wires is 13.50 %.

According to Tables (A) and (B), the zinc wire of this invention has a relatively high ductility or tensile strength as compared to the comparative specimen.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A method for manufacturing a zinc wire, comprising the steps:

(1) casting a molten zinc ingot into a zinc rod;

(2) annealing the zinc rod by heating the zinc rod at a temperature of 250° C.–310° C. for more than 30 minutes, and then cooling the zinc rod to room temperature;

(3) extruding the annealed zinc rod at a temperature of 250° C.–310° C. to form a zinc bar;

(4) air cooling the zinc bar to room temperature after step (3);

(5) immersing the cooled zinc bar into a liquid having a boiling point of about 100° C.–150° C.;

(6) heating the liquid at its boiling point for a period;

(7) subsequently removing the zinc bar from the liquid, and then baking and drying the zinc bar;

(8) forming the baked zinc bar into a rough zinc wire by continuous rolling;

(9) subjecting the rough zinc wire, after rolling, to a treatment for peeling off a surface layer of the rough zinc wire; and

(10) subsequent to the peeling treatment, drawing the rough zinc wire to form a finished zinc wire.

2. A method for manufacturing a zinc wire as claimed in claim 1, wherein, in step (7), the zinc bar is baked by using low pressure gas.

3. A method for manufacturing a zinc wire as claimed in claim 1, wherein, in step (6), the liquid is maintained at its boiling point for more than 20 minutes.

* * * * *